United States Patent [19]

Mount

[11] Patent Number: 4,994,676

[45] Date of Patent: Feb. 19, 1991

[54] ELECTRO-OPTICAL ION DETECTOR FOR A SCANNING MASS SPECTROMETER

[76] Inventor: Bruce E. Mount, 21810 Manada Ct., Diamond Bar, Calif. 91765

[21] Appl. No.: 544,798

[22] Filed: Jun. 25, 1990

Related U.S. Application Data

[63] Continuation of Ser. No. 312,514, Feb. 21, 1989, abandoned.

[51] Int. Cl.[5] ..... H01J 39/44

[52] U.S. Cl. ..... 250/298; 250/281; 250/299; 250/300; 250/397; 250/213 VT

[58] Field of Search ..... 250/298, 299, 300, 392, 250/423 R, 423 F, 213 VT; 350/46.21, 46.23, 46.24, 46.25

[56] References Cited

U.S. PATENT DOCUMENTS

| | | | |
|---|---|---|---|
| 3,659,236 | 4/1972 | Whitehead, Jr. | 250/298 |
| 3,787,790 | 1/9174 | Hull et al. | 250/298 |
| 3,812,354 | 5/1974 | Walter | 250/281 |
| 3,955,084 | 5/1976 | Giffin | 250/281 |
| 3,967,116 | 6/1976 | Geerk | 250/298 |
| 4,142,101 | 2/1979 | Yin | 250/363.01 |
| 4,174,479 | 11/1979 | Twithoy et al. | 250/299 |
| 4,473,748 | 9/1984 | Konagai et al. | 250/299 |

OTHER PUBLICATIONS

Hintenberger & Konig "Mass Spectrometers and Mass Spectrographs Corrected for Image Defects" Pergomin Press 1959 pp. 16–43.

Murphy & Mauersberger "Operation of Microchannel Plate Counting System . . ." Rev. Sci. Instrum. pp. 220–226.

Hedfjall & Ruhage "Electrooptica" Ion Detector for Gas Chromatograph/Mass Spectrometry 1981 Anal Chem pp. 1641–1644.

*Primary Examiner*—Jack I. Berman

*Assistant Examiner*—Kiet T. Nguyen

*Attorney, Agent, or Firm*—Thomas P. Murphy; Edwin T. Grimes

[57] ABSTRACT

A scanning mass spectrometer (10) in combination with an electro-optical detector (100) which enable greatly increased speed of mass determinations by detecting a limited range of masses simultaneously, thus reducing the number of discrete magnetic field adjustments required over a large range of masses. The electro-optical detector (100) includes a channel electron multiplier assembly (94) with the surface of an image plate (80) located along the ion focal plane (44) and at an angle to the exit plate (106) of the magnetic sector (26) and a fiberoptic window (134) of a special shape optically coupled between the angled image plate (80) and a photodiode detector array (140). The fiberoptic window (134) is shaped in such a way as to enable the entrance ends (entrance plane) (144) of the fibers to be parallel to the angled image plate (80) and the exit ends of the fibers (exit or second image plane) (146) to be parallel to the exit plane (106) while maintaining the ends of the fibers perpendicular to the fiber axes. The channel electron multiplier assembly (94) is within a vacuum envelope (104) and the photodiode array (140) is outside the vacuum envelope (104).

8 Claims, 5 Drawing Sheets

ELECTRO-OPTICAL ION DETECTOR FOR A SCANNING MASS SPECTROMETER

This is a continuation of application Ser. No. 07/312,514, filed 02/21/89.

BACKGROUND OF THE INVENTION

This invention relates, in general, to scanning mass spectrometers and, in particular, to a scanning mass spectrometer having an angled focal plane with an electro-optical ion detector to enable detection of ions over a wide mass range, both economically and with decreased analysis time.

FIG. 1 shows an artist rendition of a prior art double focus scanning mass spectrometer 10 comprising a sample inlet 12 having an ion source 14 with an ionizing region 16 in which sample gas molecules are subjected to an electron beam 20 to form an ion beam 22. The ion beam 22 is directed through an electrostatic sector 24 and a magnetic sector 26. Ions traveling through the magnetic sector are scanned as at 30 and those of a selected mass are focused at focal point 32 and directed through a narrow slit 34 to an electron multiplier 36.

FIG. 1 also shows schematically how a mass spectrometer is made compact by folding the ion path and by using magnetic scanning to limit the necessary size of the magnetic sector and also shows how the pressure is reduced in the instrument by turbo-pump 40 and ion pump 42.

In this instrument, ions of slightly higher and lower mass focus along a nearly straight line locus, i.e., focal plane 44, which passes through the axial focal point 32 and which lies at an angle to the axis 34, viz, 37.4 degrees. This focal plane 44 which lies at an angle is hereafter called an angled focal plane and illustrated in phantom in FIGS. 1*a* and 1*b*. The preciseness of the angle of this angled focal plane is a function of the geometry of the instrument, i.e., the 90 degree electrostatic sector and the 90 degree magnetic sector. The effect of these sectors on the ions of different masses is discussed at length in an article entitled "Ion Optics" by Dr. Heinz Ewald and Dr. Heinrich Hintenberger Max Planck-Institut fuer Chemie, Mainz "Methoden und Anwendungen der Massenspektroskopie" Verlag Chemie G.m.b.H. Weinheim/Bergstrasse (1953) P. 52–91 and in an article entitled "Electro-Optical Detectors In Mass Spectrometry Simultaneous Monitoring of All Ions over Wide Mass Ranges" by Boettger, Giffin & Norris, ACS Symposium Series, 102:291-318.

As can be seen in FIG. 1*b*, because of the geometry of the instrument, the ions which have slightly higher and lower mass, identified therein as 32*a*, 32*b*, 32*c* and 32*d* by way of example, are ordinarily not detectable since they are blocked from entering the electron multiplier 36 and will continue to be blocked and undetected until the magnitude of the magnetic field is increased or decreased (also called stepped or adjusted) to bring these ions into focus and directed to the electron multiplier 36. When the magnetic field intensity is changed, time is required for this change and for subsequent stabilization to the new value. Typically for toxic gas monitoring, the stepping and stabilization times cause an increase in cycle time so that the total acquisition time for 50 ports may be up to 3 hours. This is because a typical system may be required to measure up to 40 different gases, each one requiring 15 discrete magnetic field settings, and these measurements repeated for each of 50 ports.

This invention provides a means for detecting ions along this angled focal plane using an electro-optical ion detector with the image intensifier plate of a channel electron multiplier assembly placed at the angled focal plane giving essentially simultaneous analysis of a limited range of ion masses, but switchable over several ranges for detection over a wide mass range. Thus, changing of the magnetic field is required less often for detection of a wide range of ion masses. For example, utilizing this invention, the magnetic field would need to be readjusted only 6 times to detect mass 40 to 400 versus up to 600 times if the mass spectrometer is used without the electro-optical detector.

Electro-optical detectors in mass spectrometers have been used before, but the image intensifier plate was placed normal to the magnetic sector exit port or placed at a very small angle. These prior art instruments were designed to have a long focal plane, a large image intensifier, and a correspondingly long fiberoptic assembly (window).

These channel electron multiplier assemblies are also called microchannel plate assemblies and the image intensifier plate is also called a microchannel electron multiplier, a microchannel plate, a photo cathode plate, or simply an image plate.

FIGS. 2*a* and 2*b* are examples of such prior art detectors which are more fully explained in the Boettger et al article, supra.

In FIG. 2*a*, the channel electron multiplier assembly 50 is connected to the output of a magnetic sector 26*a* of a non-scanning type mass spectrometer, also called a spectrograph type mass spectrometer, and the image plate 52 is coupled to a fiberoptic window 54 and to a photodiode array 56. The image plate 52 is located along the focal plane of the magnetic sector 26, such as in FIG. 1, and a phosphor coating 60 on the entrance ends of the fiberoptic window 54 transforms the electron energy from the image plate 52 into light energy which, in turn, is transferred to the photodiode array 56 outside the vacuum envelope represented by the vacuum flange 62. The image plate 52 comprised a linear array of 14 one inch long microchannel electron multipliers and the photodiode array 56 comprised 14 one inch long photodiode detectors, each of which contained a linear array of 1024 diodes. This prior art photo-diode array 56 had a number of difficulties and limitations including; (1) the detector had to be quite large in order to cover a large mass range which means extremely expensive components and associated fiberoptics, (2) a large vacuum envelope with corresponding cost penalties and (3) the photo diode array had to be extremely large which also meant a greatly increased cost.

FIG. 2*b* shows a fiberoptic window 70 coupled to an image plate 72 which is aligned with a focal plane 74 at an angle to the exit axis 76 of the ion beam 22. The maximum angle between the focal plane 74 and the image plate 72 is limited by the ability of the fibers in the fiberoptic window 70 to accept the light impinging upon the ends of the fibers. If the angle is too large, then the efficiency of light transfer is very low. The fibers in the fiberoptic window 70 must be fused together into one monolithic piece of glass; otherwise gases trapped between the fibers become extremely difficult to remove when attempting to produce high vacuum inside the analyzer.

Still another illustration of the prior art is shown in FIGS. 3*a*–3*c* and more fully explained in an article entitled "Microchannel Plate Detectors" by Wiza, Nuclear Instruments & Methods, Vol. 162, 1979, pages 587 to 601. As shown in FIG. 3*a*, the microchannel or image plate 80 is a circular glass structure with a plurality of channels 82 in which straight channel electron multipliers 84, as shown in FIG. 3*b*, are placed and optically coupled to a fiber optic window 86 the ends of which are coated with a phosphor to form a screen 90 as shown in FIG. 3*c*. The components shown in FIG. 3*c* are suitably clamped together by bolts 92, to form a channel electron multiplier assembly 94 which operates the same as the channel electronmultiplier assembly of FIG. 2*a*. Assembly 94 is commercially available and used in the present invention as will be described in full detail hereinafter.

It is an object of this invention, therefore, to provide a double focusing mass spectrometer with a electro-optical ion detector including a channel electron multiplier assembly of the type described with the image surface of the channel electron multiplier plate placed along an angled focal plane, a photodiode array, and a fiberoptic assembly of a special shape so that a limited range of ion masses can be detected essentially simultaneously so that the magnetic field is stepped fewer times thus greatly increasing measurement speed.

SUMMARY OF THE INVENTION

This invention comprises a scanning mass spectrometer in combination with an electro-optical detector. The electro-optical detector includes a channel electron multiplier assembly with the image surface of the image plate located along the ion focal plane which is at an angle to the exit plane of the magnetic sector and a fiberoptic window of a special shape optically coupled between the angled image plate and a photodiode detector array. The fiberoptic window is shaped in such a way as to enable the entrance ends (entrance plane) of the fibers to be parallel to the angled image plate, and exit ends of the fibers (exit or second image plane) to be parallel to the photodiode image plane. The channel electron multiplier assembly is within a vacuum envelope and the photodiode array is outside the vacuum envelope.

It will become apparent to those skilled in the art after a study of the drawings and the Detailed Description hereinafter; that the electrical optical detector is smaller and less costly; that the analysis speed is greatly increased because the magnetic field intensity need not be adjusted for every mass but only once for each range of masses, thus saving the adjustment and stabilization times otherwise necessary when the field is adjusted for each mass; that the fused fiberoptic window is formed so that a minimum amount of compression and stretching of the fibers occurs so as to preserve low distortion of the exit image; and that the special shape of the fiberoptic window reduces the volume of the vacuum envelope, prevents the photo detector electronics from interfering physically with other components, reduces excessive pumping time and/or excessively high capacity pumps, and enables entry and exit of the optical image at right angles to the axis of the fiber.

It will also be apparent that this invention combines the advantages of a single focal point (scanning) type mass spectrometer with a spectrograph (non scanning) type mass spectrometer by the ability to detect a limited range of masses simultaneously but incrementally detecting the full range of masses instead of detecting the full range of masses simultaneously thereby providing a scanning type mass spectrometer which is smaller, less costly and faster than current scanning mass spectrometers.

DETAILED DESCRIPTION

FIGS. 1*a*–*b*, 2*a*–*b* and 3*a*–*c* were described at length in the Background of the Invention and need not be described further herein.

Figure 1B:
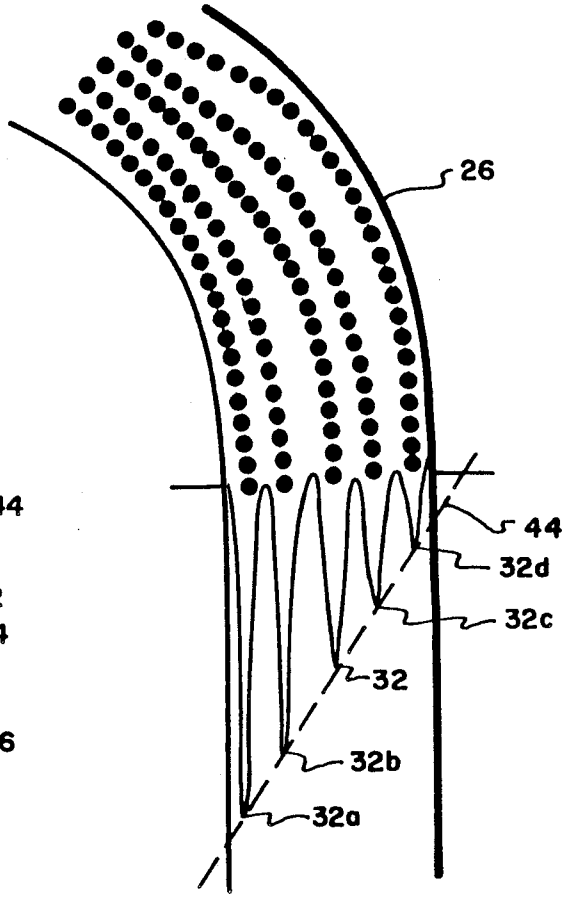
Fig. 1b. PRIOR ART
FIG. 1*b* is an enlargement of the area near the angled focal plane of FIG. 1*a*.
Figure 1A:
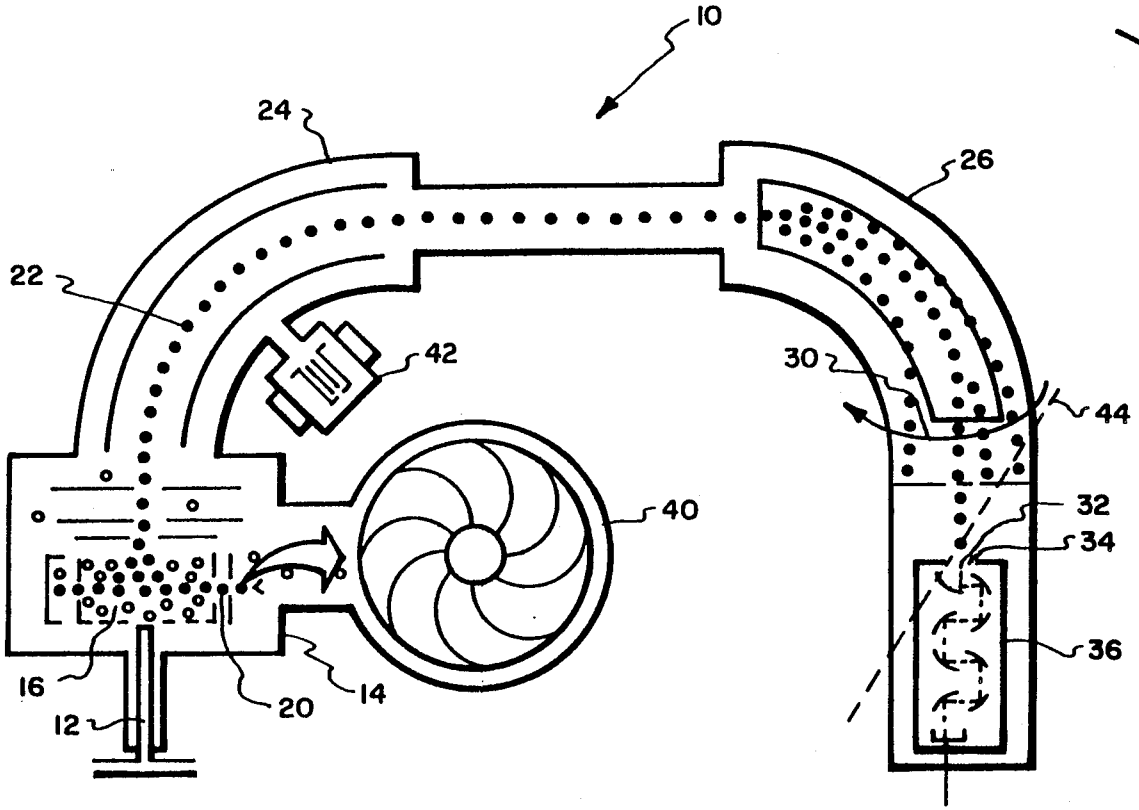
Fig. 1a. PRIOR ART
FIG. 1*a* is a schematic illustration of a prior art scanning mass spectrometer with an electron multiplier in the detector section of the instrument as described above.
Figure 2B:
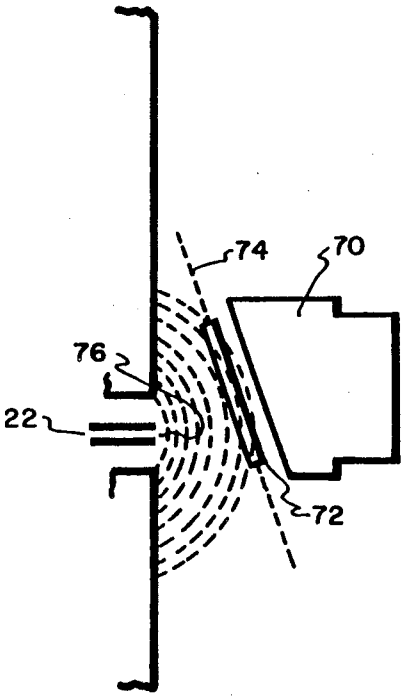
Fig. 2b. PRIOR ART
FIG. 2*b* shows a fiberoptic window coupled to a image plate which is aligned with a focal plane at an angle to the exit normal as described above.
Figure 2A:
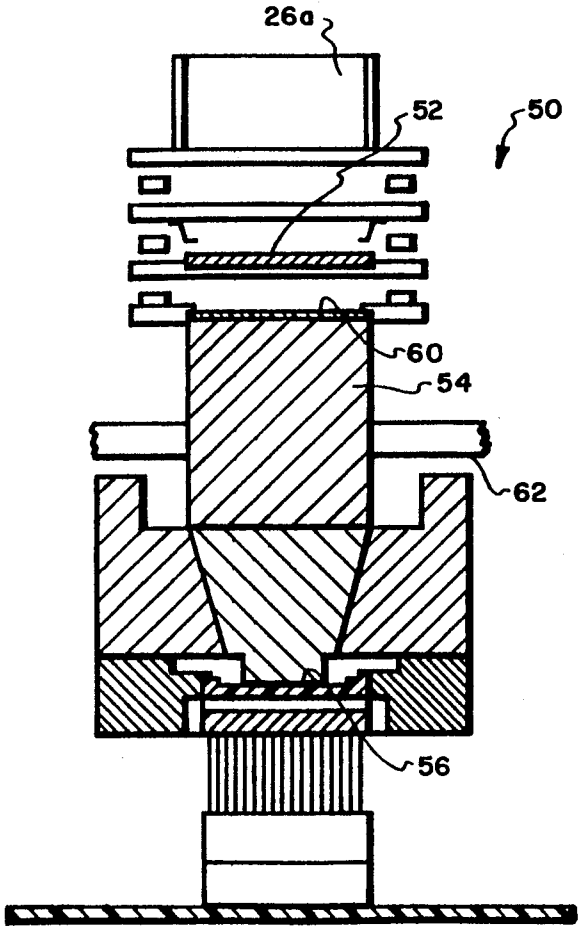
Fig. 2a. PRIOR ART
FIG. 2*a* is a schematic illustration of an electro-optical ion detector for spector type mass spectrometers as described above.
Figure 3A:
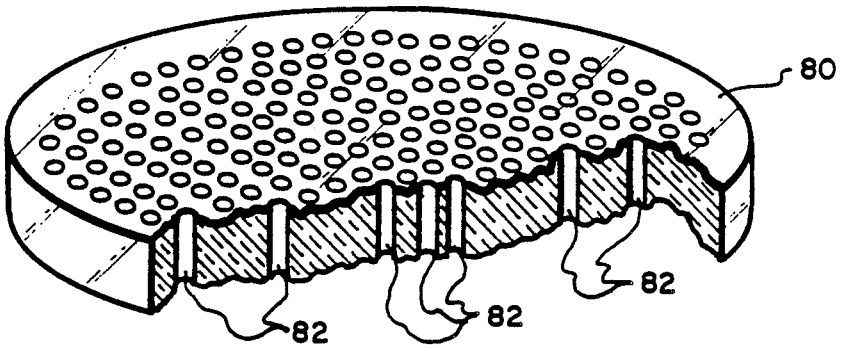
Fig. 3a. PRIOR ART
FIGS. 3*a*–3*c* illustrate the components of a channel electron multiplier assembly.
Figure 3B:
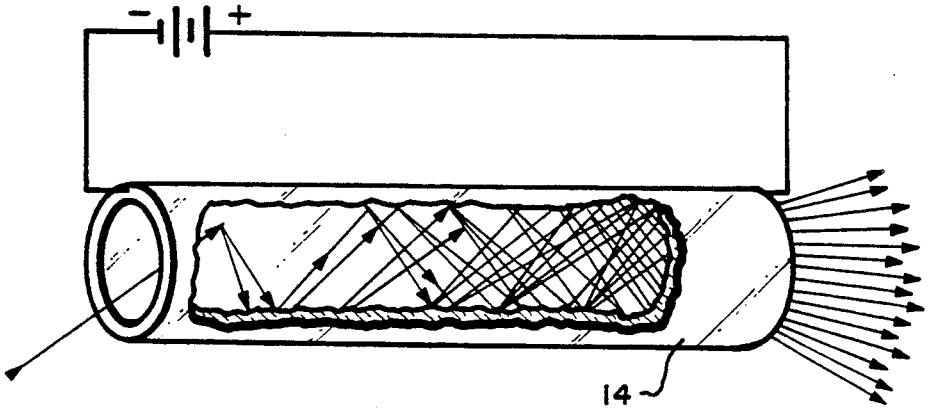
Fig. 3b. PRIOR ART
Figure 3C:
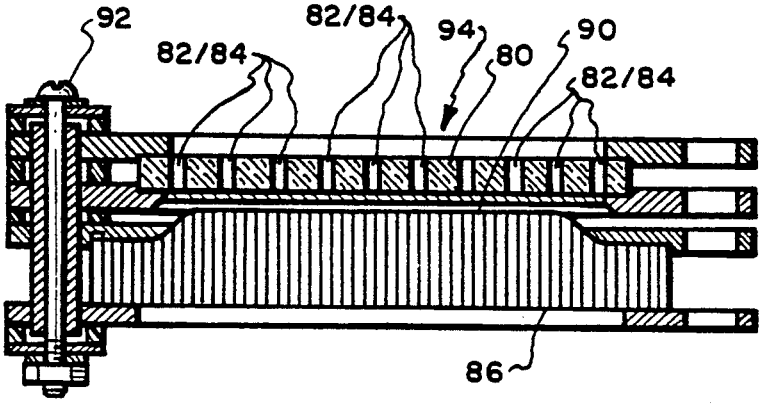
Fig. 3c. PRIOR ART
Figure 4:
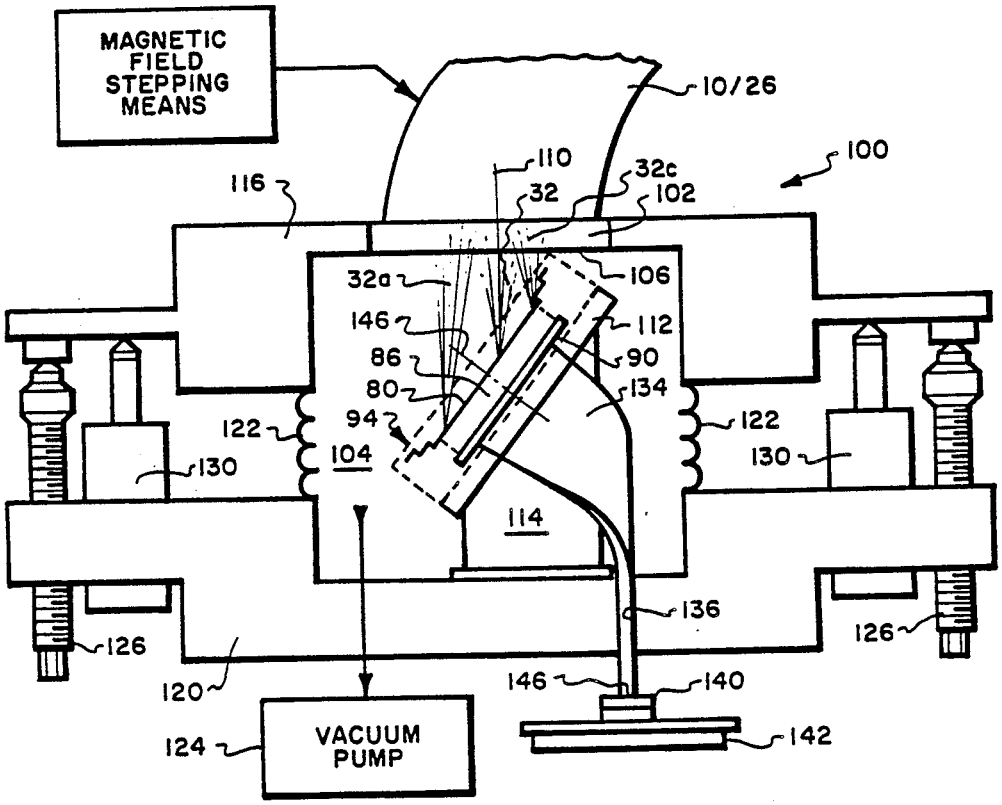
FIG. 4 illustrates the electro-optical detector of this invention including a fused fiberoptic assembly configured to a particular shape and connected to a specially positioned channel electron multiplier assembly and to a photodiode array.
Figure 5A:
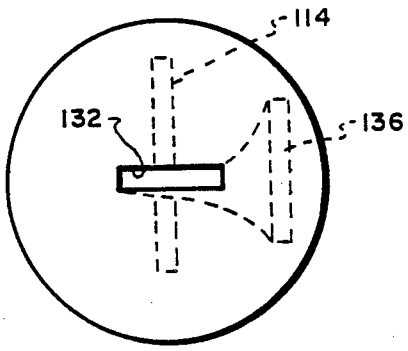
FIGS. 5*a* & 5*b* illustrate the support plate for the channel electron multiplier assembly and the pedestal for supporting the support plate.
Figure 5B:
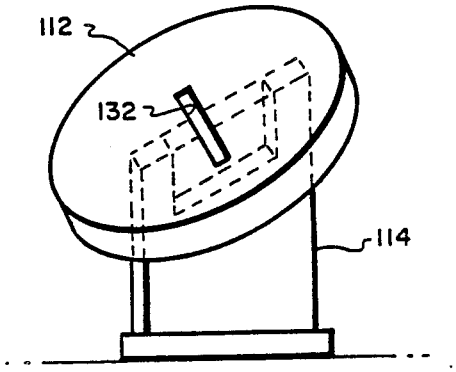

FIGS. 4 and 5*a*–*b*, on the other hand, illustrate schematically the electro-optical detector 100 of this invention connected at the exit plate 102 of the magnetic sector 26 of the scanning mass spectrometer 10, such as described above. The exit plate 102 of the magnetic sector 26 is shown schematically and also shown coupled centrally of the top of a vacuum envelope 104 with the exit plane 106 located at the magnetic center of curvature 110 so that ions will be directed toward the surface of the image plate 80 of the channel electron multiplier assembly 94 within the vacuum envelope 104. The image plate 80 of the channel electron multiplier assembly 94 corresponds to the device described in FIGS. 3*a*–*c* and the same reference numerals are used in this figure for simplicity purposes. The high and low mass ions 32*a* and 32*c*, outwardly of the central ion beam 32*b*, are focused and shown impinging on the surface of the image plate 80 as described in FIGS. 1*a*–*b*.

The image plate 80 is located at an angle to the exit plane 106 which corresponds to the angled focal plane 44 and is supported by a support plate 112 which in turn is supported by any suitable means such as pedestal 114. See FIGS. 5*a* and 5*b*. The vacuum envelope 104 is formed by two body members 116 and 120 and a flexible coupling 122 and the vacuum in the vacuum envelope 104 is maintained by a vacuum pump 124. The two body members 116 and 120 are movable relative to one another by a plurality of adjustment screws 126 to vary the location of the image plate 80 relative to the exit plane 106; it being understood that the pedestal is connected to the lower body member 120, also called a vacuum flange. Transducers (linear variable differential transformers) 130 provide a means of precise measurement of the position of the lower body member 120 relative to the upper body member 116 from which the position of the image plate 80 may be determined.

The support plate 112 has a central rectangular shaped aperture 132 through which a twisted fiberoptic window 134 is optically coupled to the fiberoptic window 86 containing the phosphor coating 90 and extends through an opening 136 in the vacuum flange 120 and is connected to a photodiode detector array 140. The photodiode array 140 is connected to suitable electronics 142 to provide the necessary signal generated by the detected ions. The photodiode detector 140 is disposed parallel to the exit plane 106.

As mentioned before, a standard channel electron multiplier assembly, such as 94, is commercially available and may be obtained from Galileo Corp, Sturbridge, Mass. or from Hamamatsu Corp, Japan. Microchannel plate assemblies 94 are commonly supplied with the fiberoptic window 86 covered with the phosphor coating 90 which converts the secondary electron energy to a visible light image, which is guided through the fiberoptic window 86.

Typical photodiode arrays, such as photodiode detector 140, comprise an array of perhaps 1024 photodiodes formed onto an integrated circuit, and packaged with a fiberoptic window over the array. One such array is the Hamamatsu S2304-1024F, and another is the EG&G Reticon RL10248F. Each of these example arrays are one inch in length, and 0.100 inch wide. Therefore, a typical fiberoptic window could be one inch wide, 0.125 inch thick, and three to four inches long, depending upon the distance from the channel electron multiplier assembly 94 to the vacuum flange 120.

Figure 6A:
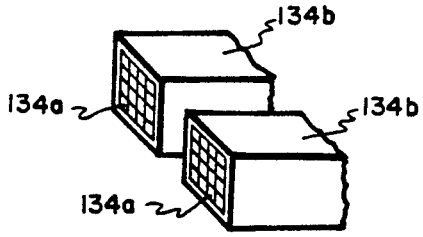
FIGS. 6*a*–6*g* illustrate the manner of forming the fiberoptic window.
Figure 6B:
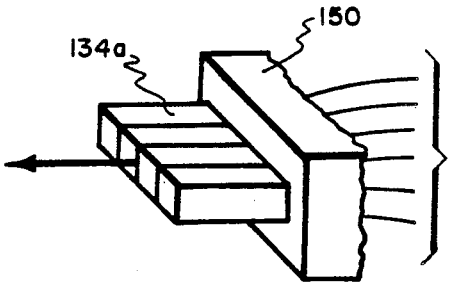
Figure 6C:
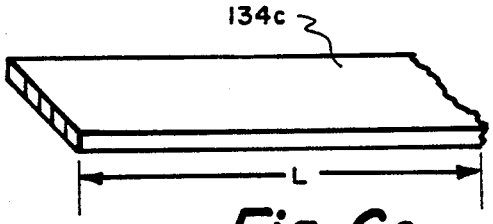
Figure 6D:
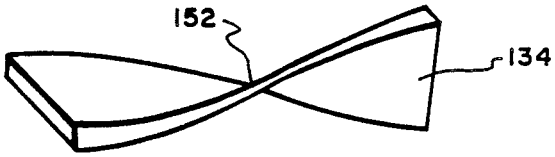
Figure 6E:
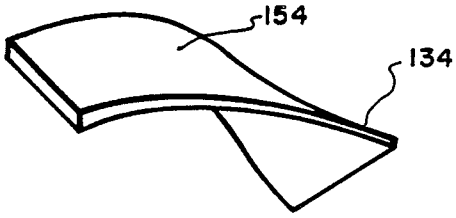
Figure 6F:
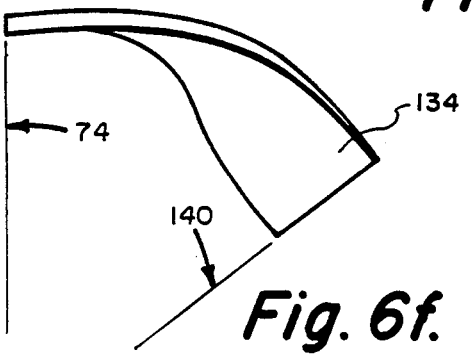
Figure 6G:
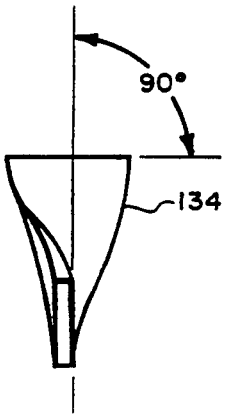

As shown in FIG. 4, the fused fiberoptic window 114 is shaped in such a way as to enable the entrance ends of the fibers to be parallel to the angled image plate 80. FIGS. 6*a*–6*g* show the manner in which the fiberoptic window 134 is formed. As shown in FIG. 6*a*, the fibers 134*a* are drawn and fused into bundles 134*b*, rectangular in cross section, and several coherent bundles 134*b* are then drawn through a die 150 under a controlled heat as shown in 6*b* to form a fused glass ribbon 134*c* and cut to a predetermined length L as shown in 6*c*. The width of the ribbon is equal to the length of the desired focal plane and the thickness is kept as thin as the width of the exit image will allow depending upon the width of the image plate 80 and the photodiode detector array 140. After the fibers are fused into the ribbon shape as shown, the ribbon is allowed to cool. After cutting to length, the ribbon is reheated and first twisted 90 degrees as shown at 152 in FIG. 6*d* and then bent beyond the twisted portion 152 as shown at 154 in FIGS. 6*f* and 6*g*. By forming this latter angle beyond the twisted portion 152, minimum compression and stretching of the fibers takes place, assuring minimum distortion of the exit image. The ends of the fibers are now ground and polished perpendicular to the axes of the fibers for maximum light acceptance efficiency.

If the exit or second image plane 146, could be positioned parallel to the image plate 80 and the exit plane 146 in line with the center of the image plate 80, there would be no need for the special fiberoptic shape. The special shape is needed (1) because of the need to contain a minimum volume inside the vacuum envelope 104, and (2) to prevent the photodetector electronics from physically interfering with the other components of the analyzer. Minimum volume inside the vacuum envelope 104 is important to prevent excessive pumping time and/or excessively high-capacity vacuum pumps.

With the foregoing, the analysis speed may be greatly increased and even though the electro-optical detector 100 will not cover a complete mass range, the magnetic field intensity need not be adjusted for every mass, but only once for each range of masses, thus saving the adjustment and stabilization times necessary when adjusting the field intensity for each mass.

A typical mass range that can be practically measured over a one inch focal plane at a given constant magnetic field intensity is about 1.5 to 1, so that if the total mass range to be measured by the electro-optical detector 100 were 40 to 400, then the typical ranges might be:

| Range No. | From Mass | To Mass |
|---|---|---|
| 1 | 40 | 60 |
| 2 | 60 | 90 |
| 3 | 90 | 120 |
| 4 | 120 | 180 |
| 5 | 180 | 270 |
| 6 | 270 | 405 |

Therefore, the magnetic field would need to be readjusted only 6 times from mass 40 to 400 versus up to 600 times if used without the electro-optical detector.

I claim:

1. In combination, a scanning mass spectrometer with at least a magnetic sector in which the magnitude of the magnetic field is changeable and an electro-optical detector, said magnetic sector having an exit plane and directing and focusing an ion beam of a limited range of ion masses at an angle into said electro-optical detector spaced from said exit plane, said electro-optical detector including a channel electron multiplier assembly with an image plate, a fiberoptic window and a photodiode detector parallel with said exit plane, said image plate being at an angle to the exit plane of said magnetic sector which angle corresponds to the angle at which said ion beam is focused so as to be impinged upon by said limited range of ion masses enabling a greatly increased speed of mass determinations by detecting said limited range of masses simultaneously, thus reducing the number of magnetic field changes required over a large range of masses, said fiberoptic window having an entrance end coplanar with said image plate and an exit end coplanar with said photodiode detector and wherein, said fiberoptic window comprises a plurality of optic fibers arranged in a flat ribbon-like configuration which is twisted so that an exit of an optical image of the ion masses from said window is rotated 90 degrees from an entry of said optical image and is parallel to said photodiode detector.

2. The combination as claimed in claim 1 wherein the magnitude of the magnetic field is stepped to vary the range of ion masses impinging on said image plate.

3. The combination as claimed in claim 1 wherein said channel electron multiplier is movable relative to said magnetic sector.

4. The combination as claimed in claim 2 further including a back support plate and support means for locating said image plate at the angle at which said ion beam is focused by said magnetic sector.

5. The combination as claimed in claim 1 including means defining a vacuum envelope containing said channel electron multiplier assembly and part of said fiberoptic window.

6. The combination as claimed in claim 7 wherein said vacuum envelope is variable in volume.

7. The combination as claimed in claim 5 wherein said means defining a vacuum envelope comprises upper and lower body members and a flexible coupling.

8. The combination as claimed in claim 6 wherein said photo detector is located outside the vacuum envelope.

* * * * *